US011224248B2

(12) United States Patent
Sikora

(10) Patent No.: US 11,224,248 B2
(45) Date of Patent: Jan. 18, 2022

(54) METHOD AND AN APPARATUS FOR MANUFACTURING ROD-LIKE ARTICLES FOR TOBACCO INDUSTRY

(71) Applicant: International Tobacco Machinery Poland Sp. z o.o., Radom (PL)

(72) Inventor: Leszek Sikora, Radom (PL)

(73) Assignee: International Tobacco Machinery Poland Sp z o.o., Radom (PL)

( * ) Notice: Subject to any disclaimer, the term of this patent is extended or adjusted under 35 U.S.C. 154(b) by 0 days.

(21) Appl. No.: 16/703,641

(22) Filed: Dec. 4, 2019

(65) Prior Publication Data

US 2020/0196659 A1 Jun. 25, 2020

(30) Foreign Application Priority Data

Dec. 19, 2018 (EP) ..... 18214022

(51) Int. Cl.

| | |
|---|---|
| ***A24C 5/01*** | (2020.01) |
| ***A24C 5/18*** | (2006.01) |
| ***A24C 5/28*** | (2006.01) |
| ***A24C 5/34*** | (2006.01) |

(52) U.S. Cl.

CPC ..... *A24C 5/01* (2020.01); *A24C 5/1892* (2013.01); *A24C 5/28* (2013.01); *A24C 5/3412* (2013.01)

(58) Field of Classification Search

CPC ..... A24C 5/01; A24C 5/1892; A24C 5/28; A24C 5/34; A24C 5/3412

See application file for complete search history.

(56) References Cited

U.S. PATENT DOCUMENTS

2015/0257437 A1 9/2015 Wood et al.

FOREIGN PATENT DOCUMENTS

| | | | |
|---|---|---|---|
| GB | 1281371 | A | 7/1972 |
| WO | 2000074505 | A1 | 12/2000 |
| WO | 2016184928 | A1 | 11/2016 |

OTHER PUBLICATIONS

EPO Extended European search report, application No. EP 18 21 4022, dated Jun. 25, 2019.

*Primary Examiner* — Eric Yaary
(74) *Attorney, Agent, or Firm* — Soody Tronson; STLG

(57) ABSTRACT

A method for manufacturing rod-like articles for tobacco industry, the rod-like articles comprising longitudinal inserts located in a filling material, the method comprising: feeding a continuous tape-like wrapper; feeding a strand of the filling material onto the moving wrapper; feeding an insert material, in a form of a tape having weakenings, into the strand of the filling material; forming a continuous rod by wrapping the wrapper around the strand of the filling material with the insert material; cutting the moving continuous rod into discrete rod-like articles by a cutting head at a cutting plane that traverses the weakening in the tape of the insert material; the method being characterized by: inspecting ends of the insert in the rod like article cut from the continuous rod and comparing the ends with a predefined model to obtain a measure of similarity; and depending on the similarity, adjusting the action of the cutting head with respect to the movement of the continuous rod such as to increase the similarity between the ends of the insert to the model in a following rod like article.

18 Claims, 10 Drawing Sheets

METHOD AND AN APPARATUS FOR MANUFACTURING ROD-LIKE ARTICLES FOR TOBACCO INDUSTRY

TECHNICAL FIELD

The present invention relates to manufacturing rod-like articles for tobacco industry.

BACKGROUND

In the art there are known devices for placing various types of objects in rod-like articles. Both spherical and longitudinal objects are placed in the filter material of the mouthpiece part of the cigarette as well as in the tobacco part. Currently, tobacco products of the type "heat non burn", i.e. products in which the material generating the aroma is heated, is encountered. Such products are characterized by a lower emission of harmful substances for the smoker in relation to traditional cigarettes in which tobacco is burned. The aroma can be produced by the heat emitted from the insert placed in the tobacco part, the tobacco in such products can be in various forms, for example tobacco cut, crinkled paper, tobacco film or a sheet of homogenized tobacco. To heat the aerosol generating material, a lamellar or rod element is usually used, which is placed inside a part of a cigarette made of material to be heated. The heating element may be placed in such a product directly by the smoker by introducing it usually from the end of the cigarette into the part in which the aerosol generating material is located, or else it may be placed therein already at the stage of producing such a cigarette. In the case where the heating element is placed in the tobacco part of the cigarette at the manufacturing stage, an external source of energy, usually electromagnetic radiation, is used to heat it. The heating element may be inductively heated, the generated energy is used to heat the tobacco material.

The placement of the heating element in the tobacco part of the cigarette takes place on machines for producing rod-like elements used in the tobacco industry. Typically, the heating element is introduced into an unformed shaft formed of the aerosol generating material by means of introducing means, usually centrally so that it is evenly surrounded on each side with the aerosol generating material.

The heating element may be inserted into an unformed shaft as a finished element of finite length or as an endless belt which, after forming the shaft, will be cut with the bars together with it.

A PCT application WO2016/184928 discloses an apparatus for inserting a continuous tape made of stainless steel into a tow of tobacco material, the tobacco material being formed into a continuous rod which is cut by means of a cutting head into single rods of predefined length. The inserts are adapted to be inductively heated and are employed to heat tobacco material e.g. aerosol forming tobacco substrate.

A PCT application WO2016/184929 discloses an apparatus for inserting strip-shaped heating elements made of ferromagnetic metal into a strand of tobacco material, the strips having predefined length are being located in the strand so the finally formed continuous rod may be cut between the inserted strips. Thus rods having strip-shaped heating elements are manufactured.

A European patent application EP2677273A1 discloses a method to estimate quality of end surfaces of rod-like articles by means of an optical unit, wherein a signal from the unit is processed by a controller. Both two-dimensional and three-dimensional measurements of the cutting surfaces are available.

SUMMARY

There is disclosed herein a method for manufacturing rod-like articles for tobacco industry, the rod-like articles comprising longitudinal inserts located in a filling material, the method comprising: feeding a continuous tape-like wrapper; feeding a strand of the filling material onto the moving wrapper; feeding an insert material, in a form of a tape having weakenings, into the strand of the filling material; forming a continuous rod by wrapping the wrapper around the strand of the filling material with the insert material; cutting the moving continuous rod into discrete rod-like articles by a cutting head at a cutting plane that traverses the weakening in the tape of the insert material. The method is further comprises inspecting ends of the insert in the rod like article cut from the continuous rod and comparing the ends with a predefined model to obtain a measure of similarity; and depending on the similarity, adjusting the action of the cutting head with respect to the movement of the continuous rod such as to increase the similarity between the ends of the insert to the model in a following rod like article.

The method may comprise adjusting the action of the cutting head with respect to the movement of the continuous rod by advancing or delaying the action of the cutting head.

The method may comprise adjusting the action of the cutting head with respect to the movement of the continuous rod by accelerating or decelerating the movement of the continuous rod.

The method may comprise inspecting the ends of the insert by analyzing images of shear surfaces of the ends of the rod-like article.

The method may comprise inspecting the ends of the insert by measuring areas of shear surfaces of the insert at the ends of the rod like article.

The method may comprise inspecting the ends of the insert by analyzing measurement signals from microwave sensors.

The method may comprise making weakenings in the insert material tape when passing the insert material tape to an assembly for feeding the insert material tape into the strand of the filling material.

The filling material may contain tobacco.

The weakening may comprise two opposite cut-outs at the edges of the insert material.

The method may comprise incrementally adjusting the synchronization of the movement of the cutting head and the movement of the continuous rod and inspecting the ends of the insert material for every adjustment.

There is also disclosed an apparatus for manufacturing rod-like articles for tobacco industry, the rod-like articles comprising longitudinal inserts located in a filling material, wherein the apparatus comprises: a wrapper feeding assembly configured to feed a continuous tape-like wrapper; a filling material feeding assembly configured to feed a strand of the filling material; an insert material tape feeding assembly configured to feed a tape of an insert material having weakenings into the strand of the filling material; a garniture assembly configured to form a continuous rod comprising the filling material and the enclosed insert material tape; a cutting head configured to cut the continuous rod into discrete rod-like articles so that a cutting plane traverses a weakening in the tape of the insert material; a conveyor configured to convey rod-like articles crosswise to the continuous rod. The apparatus further comprises: sensors configured to inspect the ends of the insert at the ends of a rod-like article; a comparing unit configured to compare the ends of the insert with a predefined model to obtain a measure of similarity; and a controller configured to, depending on the similarity, adjust the action of the cutting head with respect to the movement of the continuous rod such as to increase the similarity between the ends of the insert to the model in a following rod like article.

The controller may be configured to adjust the action of the cutting head with respect to the movement of the continuous rod by advancing or delaying the action of the cutting head.

The controller may be configured to adjust the action of the cutting head with respect to the movement of the continuous rod by accelerating or decelerating the movement of the continuous rod.

The sensors may be optical sensors configured to receive images of the shear surfaces of the ends of a rod-like article.

The apparatus may further comprise a weakening forming assembly configured to make weakenings in the insert material tape.

The method and the apparatus for manufacturing rod-like articles as disclosed herein provides reduction of energy consumption of a cutting head which is configured to cut a continuous rod. Further, it provides improvement of quality of manufactured rods.

BRIEF DESCRIPTION OF DRAWINGS

The method and the apparatus according to the invention are described herein with reference to embodiments presented in a drawing in which.

DETAILED DESCRIPTION

Figure 1:
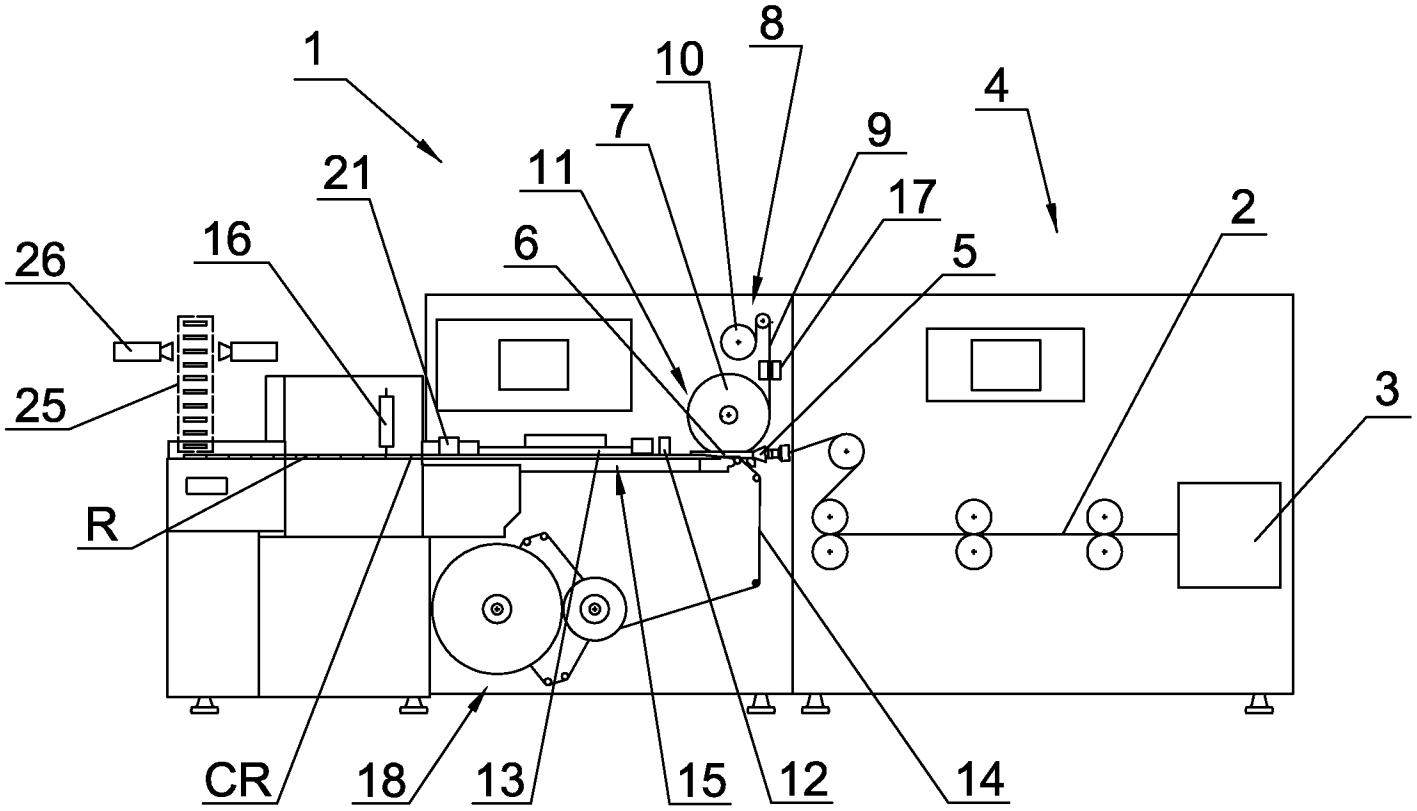
FIG. 1 presents a machine for manufacturing rods from a continuous filling material.

A rod making machine 1 presented in FIG. 1 is arranged for manufacturing rods R from a continuous strand of a filling material 2, for example a strand of homogenized tobacco supplied from a storage unit 3. The filling material may be any material which is adapted to contain flavors, preferably tobacco flavors. It may be defined as "aerosol generating tobacco material". The strand of the filling material 2 is crimped and stretched by means of rollers in a preparation unit 4 in order to facilitate forming a continuous rod. In the preparation unit the strand of the filling material 2 may be moistened or flavors may be added to it. The machine 1 is provided with a guiding element 5 having the form of a funnel through which the strand of the filling material passes from the preparation unit 4. The strand of the filling material 2 becomes initially compressed when passing through the guiding element 5. The element 5 may be provided with openings to evacuate air out of the filling material 2. The filling material that is initially compressed passes through an introducing tube 6, which acts as a guiding and compressing element. The strand of the filling material 2 attains a shape close to a manufactured rod CR. The guiding and compressing element 5 and the introducing tube 6 may be formed as a single element.

In the rod forming part of the machine 1 there is provided an insert material tape feeding assembly 8 to feed a tape of an insert material 9 into the filling material 2. The insert material may be made of metal, plastic or any other. The insert material tape 9 is fed from a bobbin 10 and passes through a weakening forming assembly 17 and to an insert material tape feeding assembly 11. The weakening is an area of the tape that has a lowered strength. The weakening forming assembly 17 may be a punching device or a laser cutting device or any other type of a device configured to form cut-outs. The weakening may have various shapes, which will be described further in the description. The insert material tape feeding assembly 11 for feeding the tape of the insert material comprises a feeding element 7, which has the form of a wheel that feeds the continuous tape of the insert material around its circumference into the strand of the filling material. Any other feeding element may be employed as well, for example a stationary guiding arch-shaped tongue. The introducing tube 6 is arranged to receive the feeding element 7 and the insert material tape 9. The filling material is placed onto a moving continuous wrapper 14 which is fed from a wrapper feeding assembly 18. The insert material tape feeding assembly 8 is provided with the weakening forming assembly 17 and the tape is weakened just before being inserted into the strand of the filling material 2. The insert material tape feeding assembly 8 may be adapted to feeding a tape having weakenings made elsewhere i.e. on another machine.

At the weakenings, the insert material tape has a lower strength. The weakenings may have the form of neckings, round or oval openings. The weakenings are supposed to facilitate the process of cutting the insert material, both when cutting off rods (which have the length of multiple plugs) and later in the process of cutting the rod into discrete plugs. When cutting the continuous rod through the weakenings, less energy is needed to cut the continuous rod, as cutting the insert itself is a process which consumes much more energy as compared to cutting a rod without any inserts.

The wrapper 14, the filling material 2 and the insert material tape 9 travel further into a garniture assembly 15 along a garniture bed provided with folding members 13, whereas glue is applied from a glue application unit 12. The glue gets dry and the wrapper 14 becomes closed to form a continuous rod. The continuous rod CR passes by a cutting head 16 and is cut into discrete rods R. The rods R are transferred to a conveyor 25 which conveys the rods R transversely to the direction of movement of the continuous rod CR. A fluted drum conveyor or a belt conveyor may be employed. Optical sensors 26 are arranged at both sides of the conveyor 25 to receive images of shear surfaces of the ends of rod-like articles.

Figure 2:
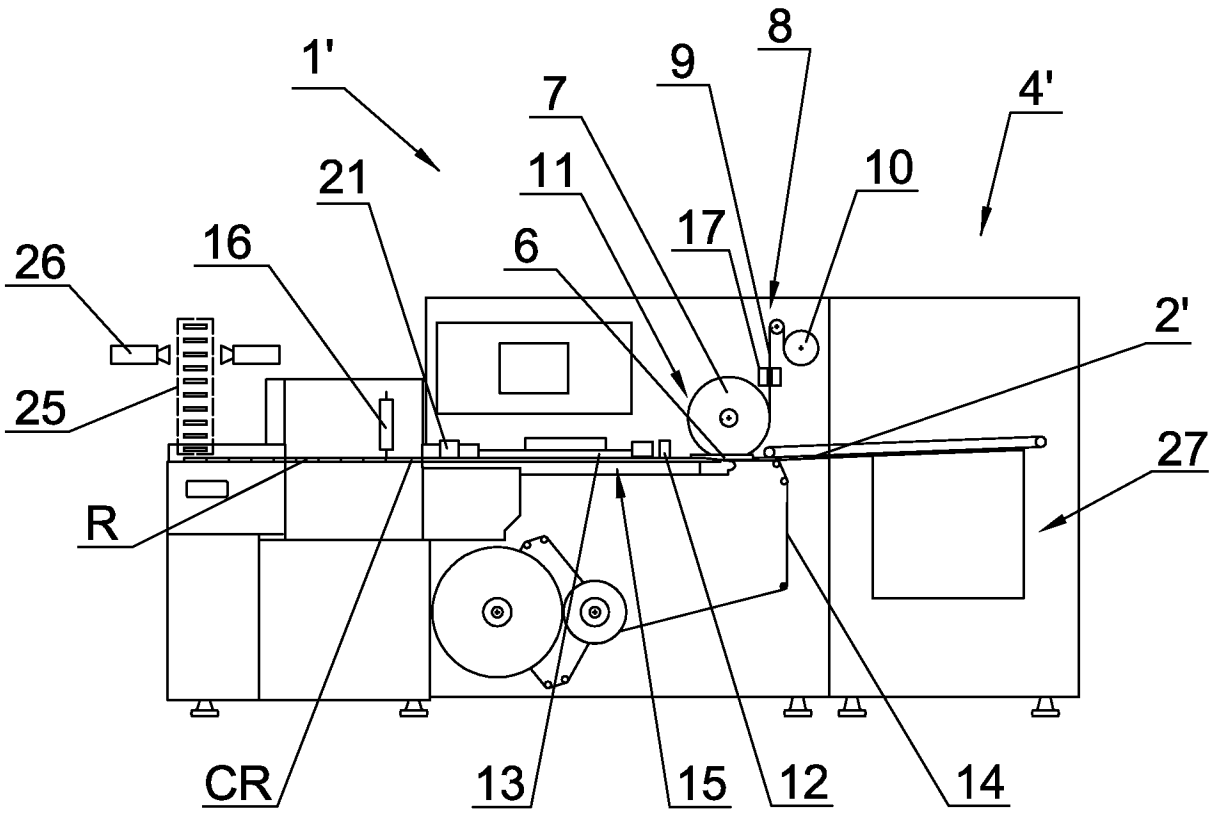
FIG. 2 presents a machine for manufacturing rods from tobacco fibers.

A machine 1' presented in a second embodiment presented in FIG. 2 is arranged to manufacture rods R from comminuted tobacco. The machine 1' is provided with a preparation unit 4' comprising a tobacco feeding assembly 27. The comminuted tobacco is delivered onto a moving wrapper 14. All the other assemblies are similar to the ones for the first embodiment.

Figure 3:
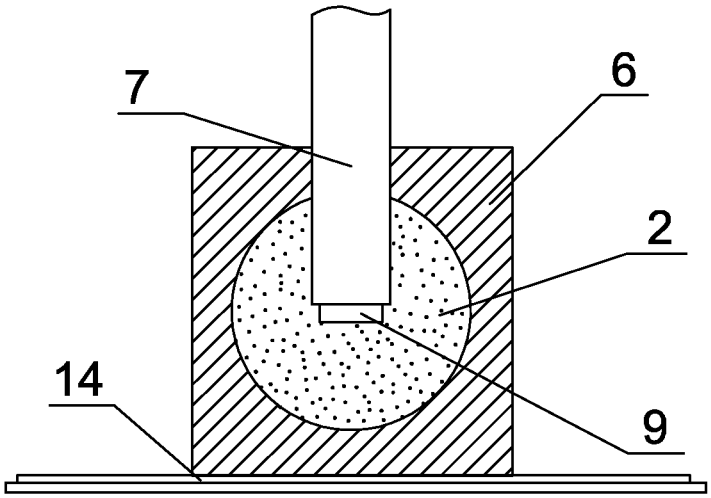
FIG. 3 and FIG. 4 present cross sections in a region of inserting a tape of an insert material.
Figure 4:
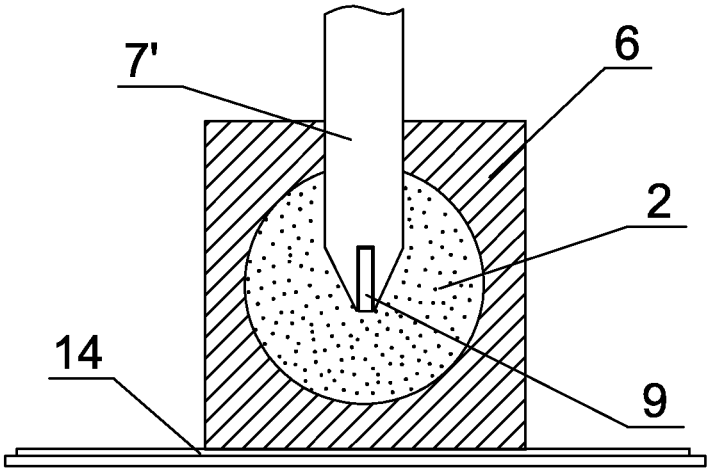

FIG. 3 and FIG. 4 present cross-sections through the feeding element 7 at the insertion point of the insert material tape 9 to present possible arrangements of the insert material tape 9. In FIG. 3 the tape 9 is arranged horizontally, while in FIG. 4 the tape 9 is arranged vertically.

Figure 5:
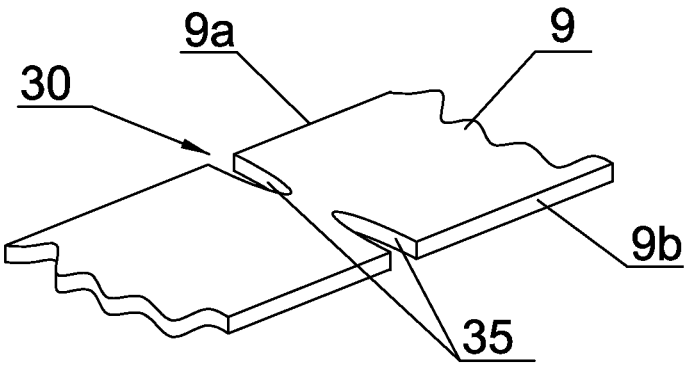
FIG. 5 and FIG. 6 present weakenings in the tape of the insert material.

FIG. 5 presents an example of a weakening 30, i.e. an area of the tape 9 of a lowered strength. There are two cut-outs 35 arranged at the edges 9*a* and 9*b* of the tape 9. The cut-outs may be of a triangular, trapezoidal or rectangular shape. Rectangular cut-outs 30' are presented in FIG. 6. They may as well be round or oval.

Figure 7:
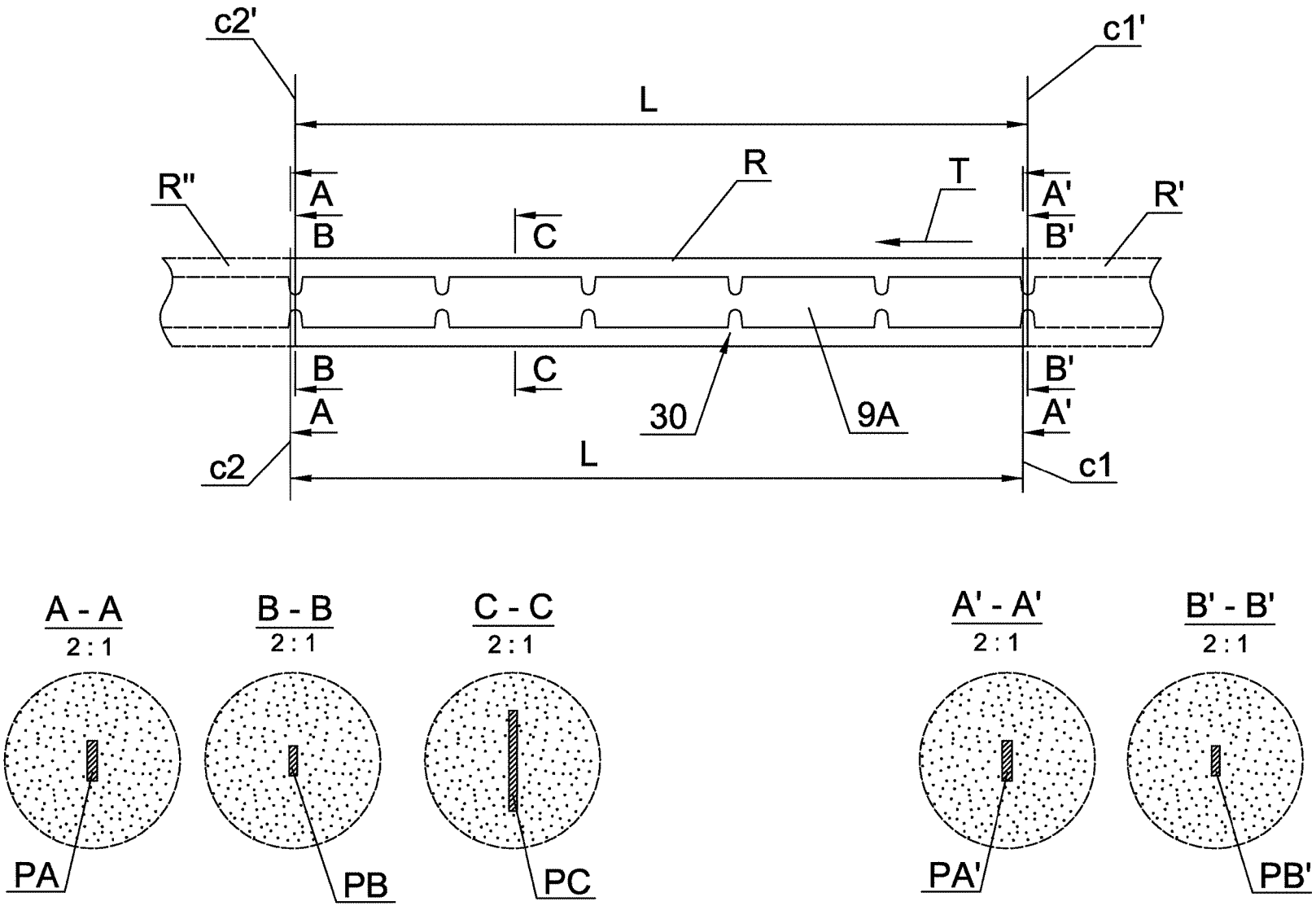
FIGS. 7 and 8 present rods R, R', R" moving in a direction T after cutting a continuous rod CR.

FIG. 7 presents rods R, R', R" moving in a direction T after cutting the continuous rod CR, the rods being shown as transparent, the insert tape 9 being provided with a plurality of weakenings 30. The length of the rods R is denoted as L between consecutive cutting planes c1 and c2 in which knives of the cutting head 16 move, each consecutive cutting is supposed to produce a rod of the length L. Cross-sections A-A and A'-A' which show images of shear surfaces of the ends of a rod-like article are substantially the same. In the presented embodiment it is assumed that every fifth weakening is distanced from another fifth weakening by a distance equal to L. As it is visible in FIG. 7, the areas PA and PA' of the shear surfaces of the insert material tape are equal to each other and greater than a target area presented in the cross sections B-B and B'-B' which are taken in the middle of the cut-out 35. A controller 23 is provided in the machine, which comprises a comparing unit 24 to compare the areas of the shear surfaces of the tape of the insert material of each consecutive cutting (exemplary areas PA and PA' which should be equal) with the target area (area PB or PB' being the smallest area of cross section either measured or defined on images taken by the optical sensor). In such a case it is required that the action of the cutting head is momentarily delayed to synchronize the cutting with the movement of a garniture tape which drives the continuous rod, thus the cutting head is synchronized with the movement of the continuous rod. The place of cutting is displaced so that the shear surface of the insert material decreases, the displacement may be realized by applying a few incremental displacements. The process is finished when the difference between the measured area PA, PA' of the shear surfaces for each consecutive cutting and the predefined target area are the same or the measured area fits in a predefined tolerance range, in other words when the ends are compatible with a predefined model. The cutting planes c1' and c2' are the adjusted cutting planes of the cutting head. The tolerance range may be defined so that the difference between the actual area of the shear surface of the tape of the insert material and the predefined target area does not exceed for example 10% of the target area. Other tolerance conditions may also be applied e.g. the actual area of the shear surface of the tape of the insert material is less than ½ of the maximum area of cross section i.e. area PC in FIG. 7. Situation that after the continuous rod has been cut and areas of the shear surfaces of the insert 9A are the smallest predefines a model of parameters for the insert, namely it relates to the position of the ends of the insert 9A. Another parameter may be the central position of the shear surface of the end of the insert in the cross-section of the end of the rod-like article.

Figure 8:
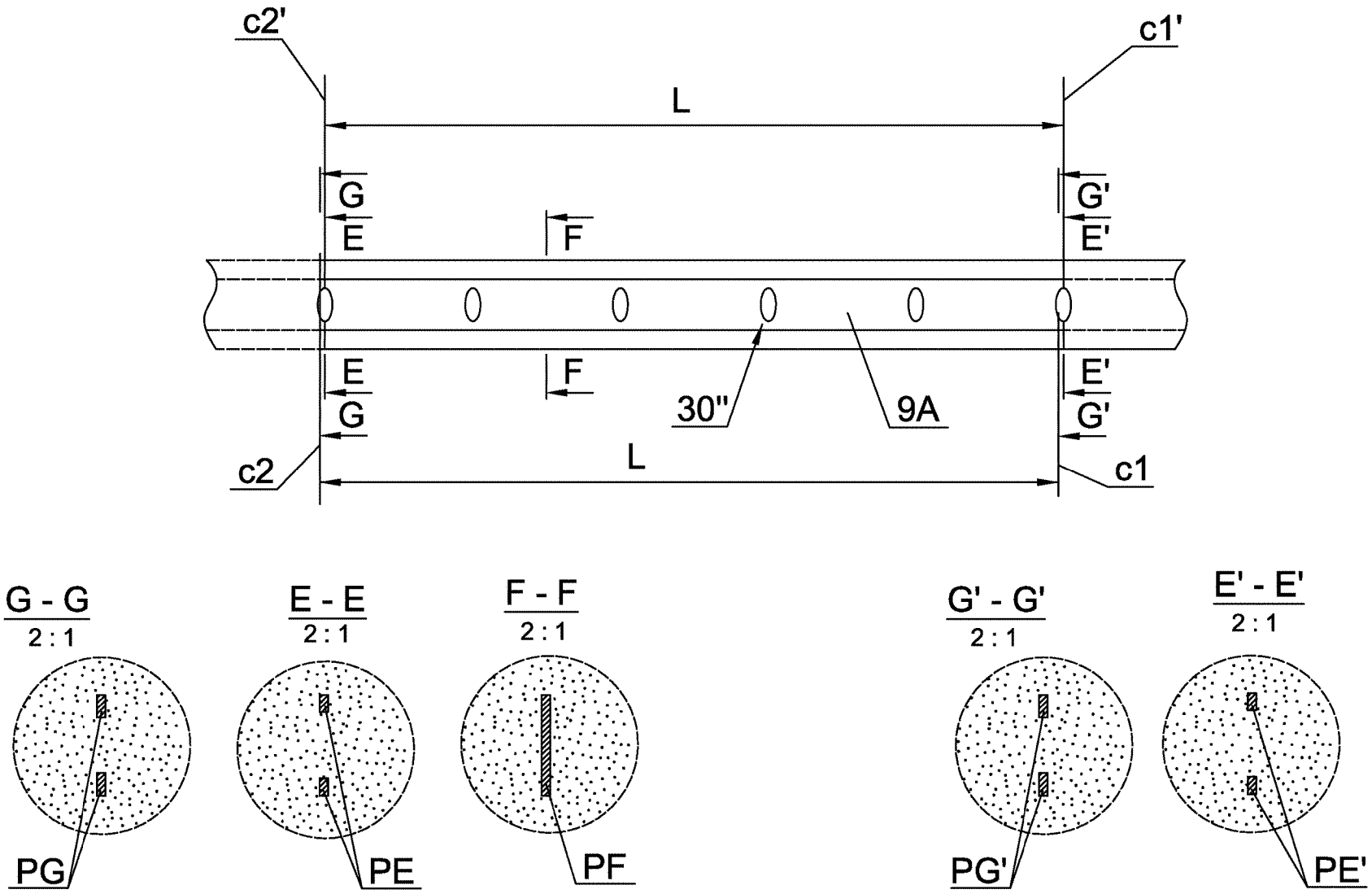

FIG. 8 presents rods R, R', R" moving in the direction T after cutting the continuous rod CR, the insert tape 9 being provided with a plurality of oval weakenings 30". In the case when the measured areas PG and PG' of cross-sections G-G and G'-G' differ from the target areas PE and PE' of cross-sections E-E and E'-E', then the cutting planes c1 and c2 must be adjusted by displacing them to c1' and c2'.

Figure 9:
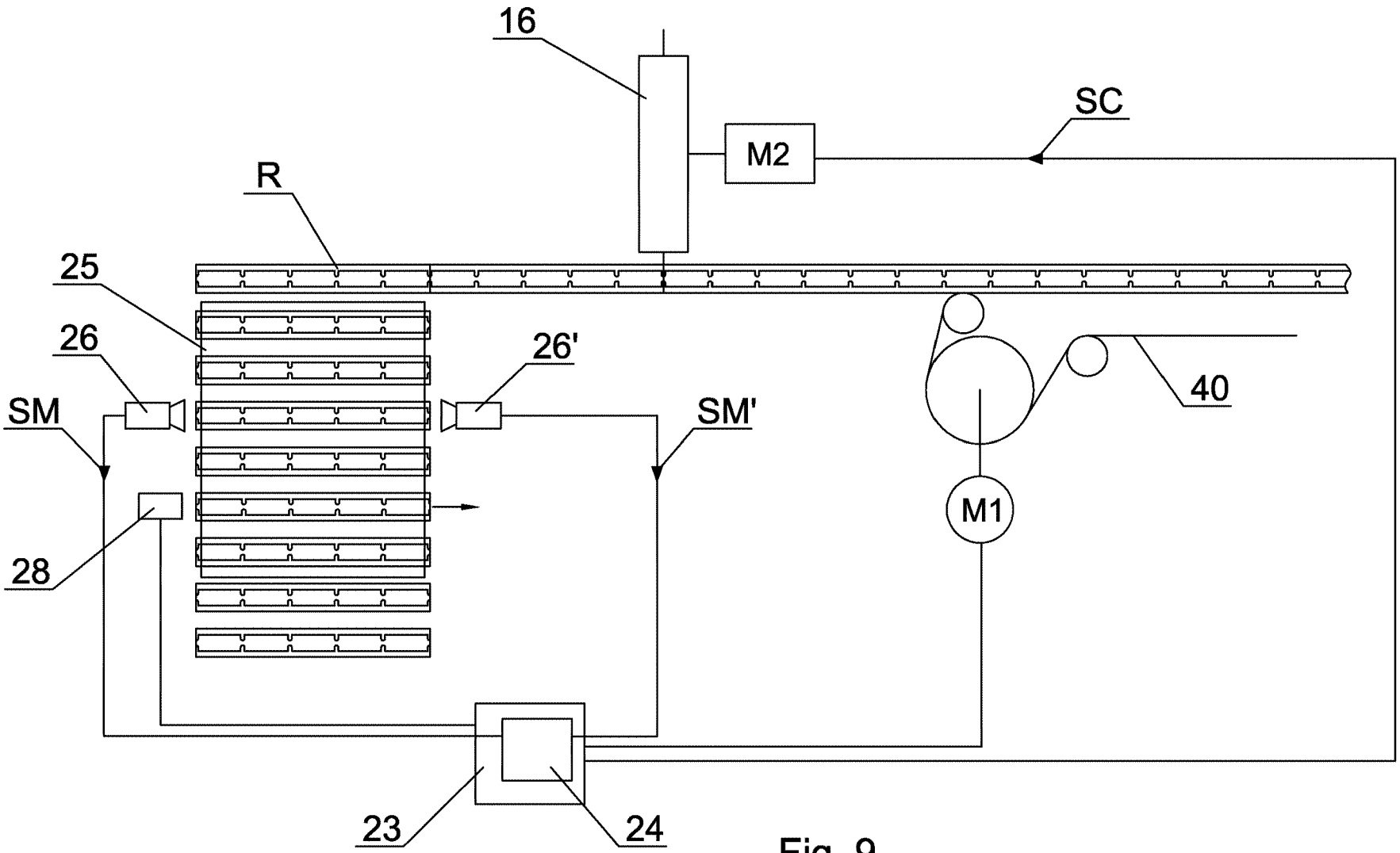
FIG. 9 presents schematically an outfeed part of a rod making machine.

FIG. 9 presents schematically an outfeed part of a rod making machine. A garniture tape 40 of the garniture assembly 15 is driven by a motor M1. The cutting head 16 is driven by a motor M2. The synchronization of the motors M1 and M2 is effected by a controller 23. The optical sensors 26 and 26' (cameras or any image sensors) provide measurement signals SM, SM' that represent images of the shear surface of the ends of the rod-like article R transported on the conveyor 25. These images are received by the controller 23 provided with the comparing unit 24 and a respective control signal SC is produced and transmitted to the motor M1 and/or M2 to adjust the action of the cutting head 16 with respect to the movement of the continuous rod CR, such that the action of the cutting head 16 is synchronized with respect to the movement of the continuous rod CR to have the ends of the insert 9A compatible with the predefined model. For example, the control signal SC may cause to advance or delay the action of the cutting head 16. Alternatively, or additionally, the control signal SC may cause to accelerate or decelerate the movement of the continuous rod CR.

The compatibility of the ends with the predefined model is assessed by inspecting the ends of the insert 9A in the rod like article R cut from the continuous rod CR and comparing the ends with the predefined model to obtain a measure of similarity. For example, the model may specify the expected value of surface area, surface shape, surface position or any other value corresponding to the output measure of the sensors 26, 38 by which the ends are inspected. The similarity is measured for example as a ratio of the output of the sensor 26, 38 and the predefined model. The ends are considered to be compatible with the model if the similarity is higher than a threshold value, for example higher than 50% or 75% or 90% or 95% or 97% or 99%. In case the similarity is lower than the threshold value, the action of the device is adjusted such as to increase the similarity between the ends of the insert (9A) to the model in a following rod like article (R). It may be that due to the time needed for the measurement and action adjustment, the similarity will be increased not for the very next rod like article R, but for an article that will be cut in a few following cutting operations. In an equivalent manner, the device may be controlled by assessing not the similarity, but a difference between the ends of the insert 9A and the model and attempting to minimize the difference.

Figure 6:
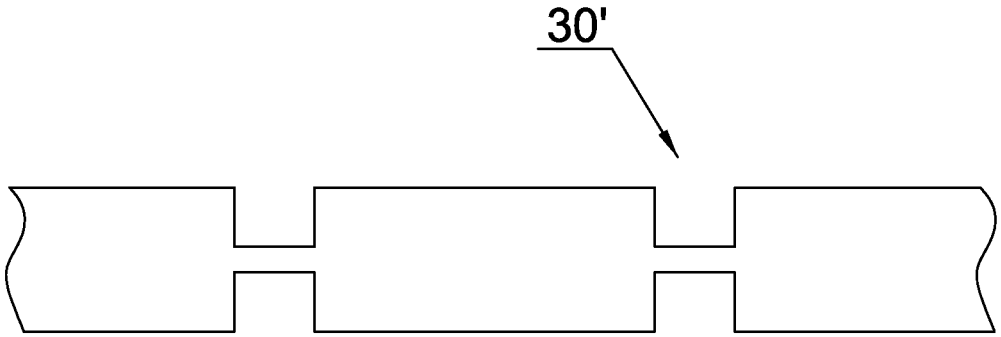

In the case when a received image discloses a faulty rod e.g. the image is the same as the cross-section C-C of FIG. 6 or F-F of FIG. 7 (in general out of tolerance range), the faulty rod may be rejected by a reject unit 28. There may be set a certain range of tolerance of the difference between a measured area and the target area of the shear surface of the insert material. A rod for which the difference exceeds the defined range shall be rejected.

Figure 10:
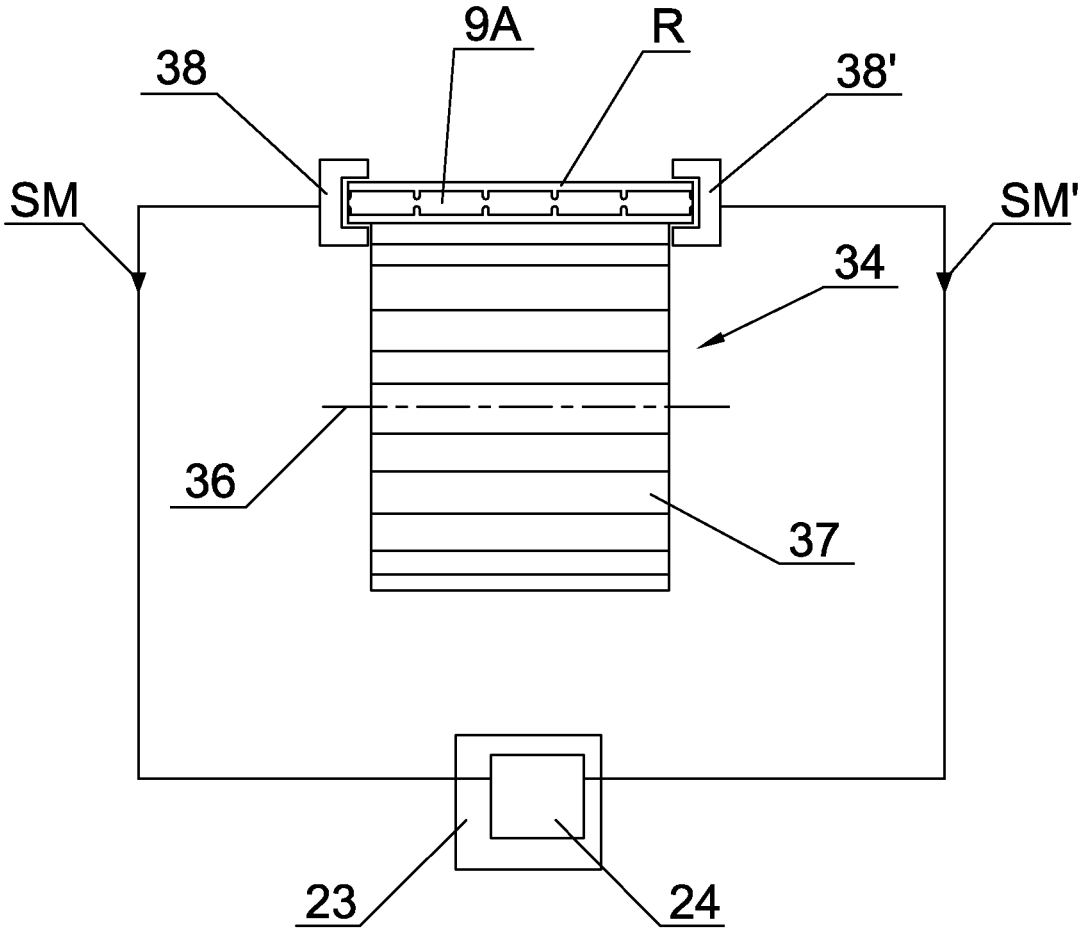
FIG. 10 presents a drum conveyor.

FIG. 10 presents a drum conveyor 34, having an axis of rotation 36 and multiple flutes 37, for conveying manufactured rods R. The location of the ends of the insert 9A at the ends of the rod-like article R is inspected by means of microwave sensors 38, 38'. The end of the inserts modifies the microwave field produced by the sensor and output signal represents the presence of the insert related to the amount of its material in the active area of the sensor. The measurement signals SM, SM' generated by the microwave sensors 38, 38' are compared by the comparing unit 24 in the controller 23.

Figure 11:
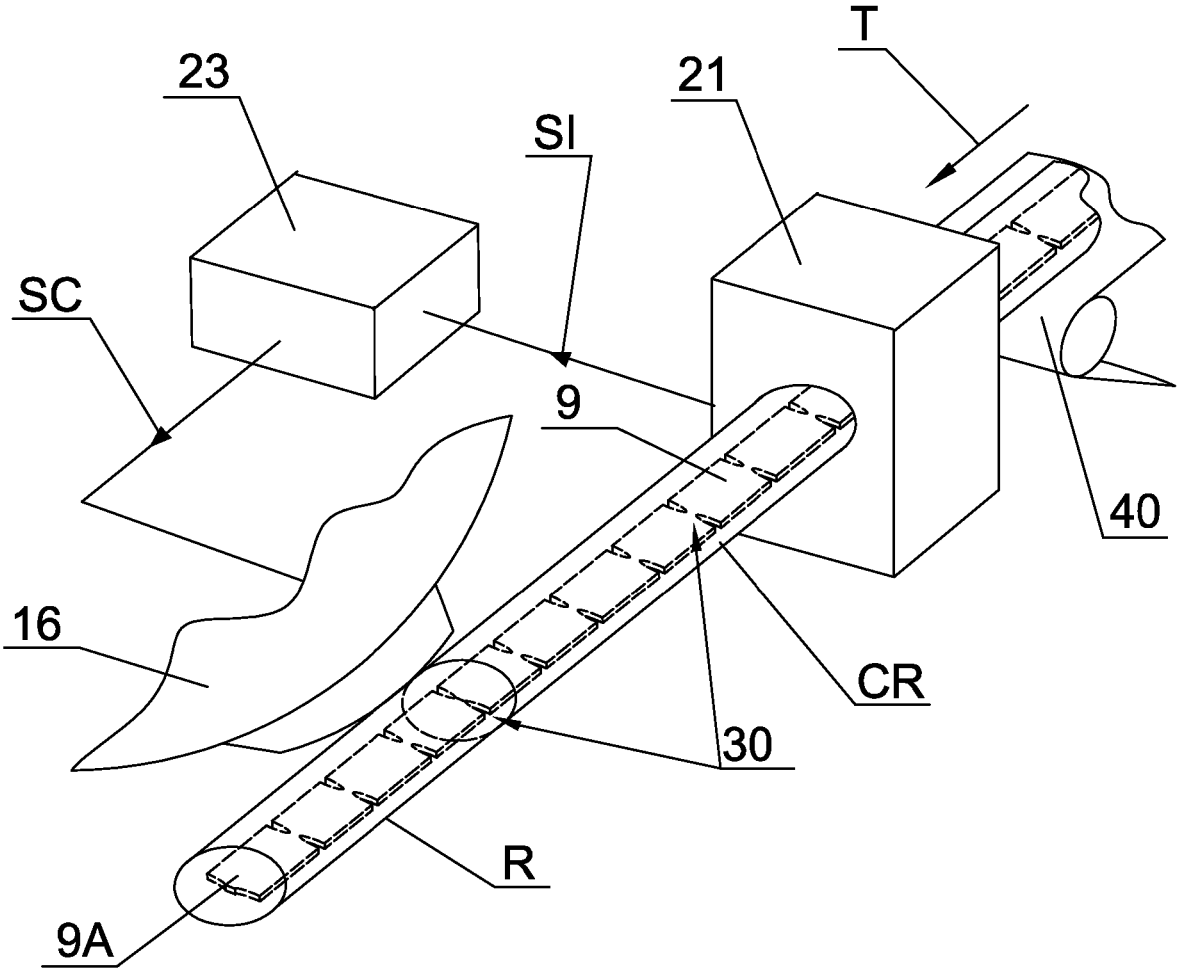
FIG. 11 presents an example of an arrangement of inspection means.
Figure 12:
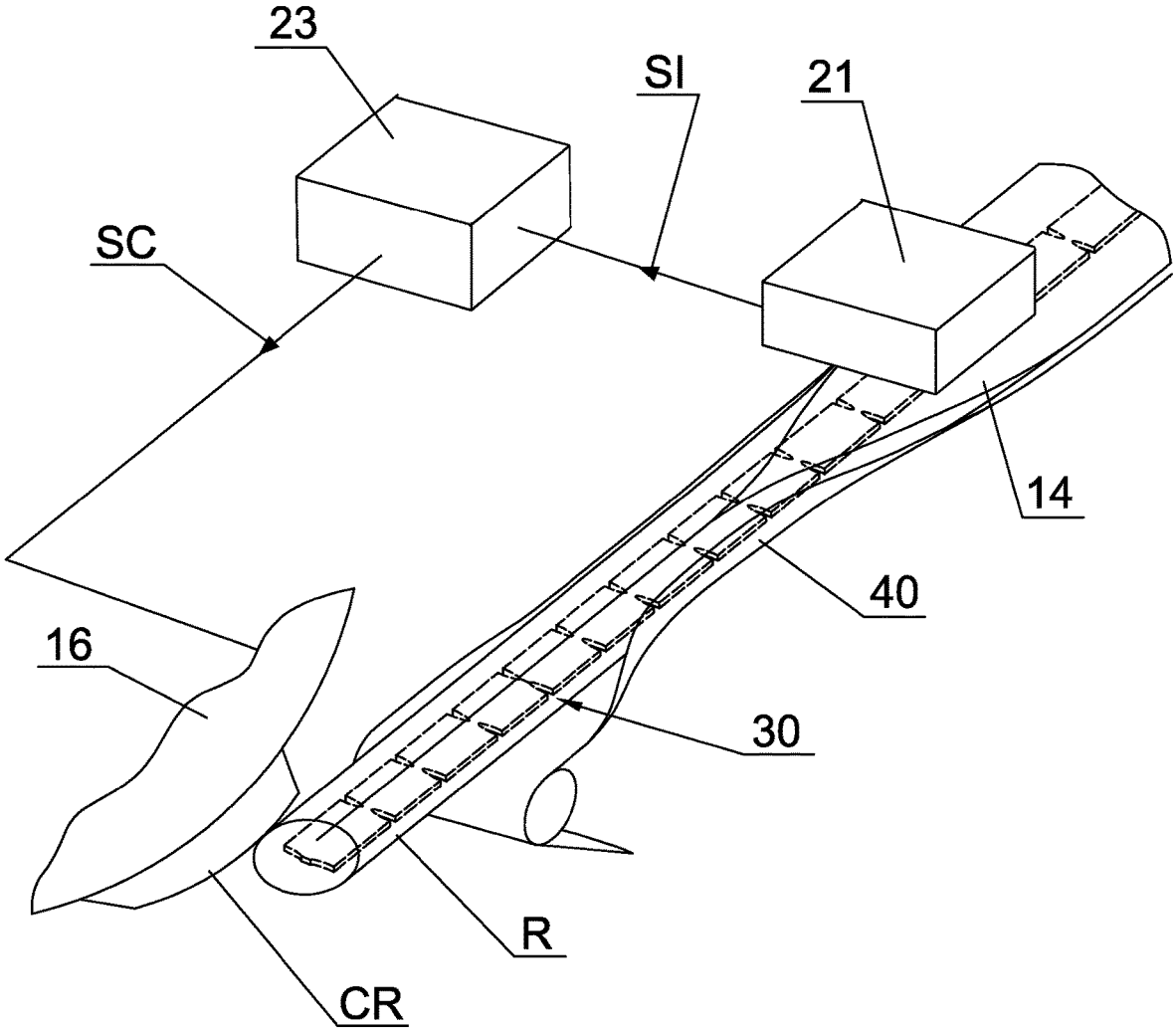
FIG. 12 presents another example of an arrangement of inspection means.

Furthermore, inspection means 21 (FIG. 11) between the garniture assembly 15 and the cutting head 16 may be employed in order to increase the efficiency of the process. The inspection means 21 detects consecutive weakenings 30 and sends an inspection signal SI to the controller 23 which is used to synchronize the movement of the cutting head 16 with the movement of the garniture tap 40 and thus with the movement of the continuous rod CR so that the cutting plane coincides with the symmetry plane of the cut-outs of a weakening 30 in the tape 9. The inspection means 21 may comprise microwave devices or optical devices (operating in visible and invisible range), as well as any other radiation-based detectors. The inspection means 21 provide initial synchronization. In case the proper synchronization is not obtained and areas of shear surfaces of insert material differ from the predefined area, it is still possible to adjust it by momentarily advancing or delaying the action of the cutting head with relation to the continuous rod i.e. to the drive of the garniture tape 40. The inspection means 21 may also be arranged ahead of the garniture assembly 15 over the garniture tape 40, i.e. in the area where the edges of the wrapper 14 are not folded as shown in FIG. 12.

The invention claimed is:

1. A method for manufacturing rod-like articles for tobacco industry, the rod-like articles comprising longitudinal inserts located in a filling material, the method comprising:

a. feeding a continuous moving tape-like wrapper;

b. feeding a strand of the filling material onto the moving wrapper;

c. feeding an insert material, in a form of a tape having weakenings, into the strand of the filling material;

d. wrapping the wrapper around the strand of the filling material with the insert material to form a moving continuous rod;

e. cutting the moving continuous rod with a cutting head at a cutting plane that traverses the weakenings in the tape of the insert material to form discrete rod-like articles terminating at ends; and f. comparing the insert at the ends of the rod-like articles with a predefined model to obtain a measure of similarity.

2. The method of claim 1, further comprising adjusting the cutting head with respect to the moving continuous rod to increase the similarity between the ends of the insert in the rod like article to the predefined model.

3. The method of claim 2, wherein the adjusting of the cutting head with respect to the moving continuous rod comprises modifying an action of the cutting head.

4. The method of claim 2, further comprising adjusting the cutting head with respect to a speed of the moving continuous rod.

5. The method of claim 2, further comprising adjusting a movement of the cutting head with respect a speed of the movement of the continuous rod.

6. The method of claim 1, wherein the ends of the rod-like articles comprise shear surfaces, the method further comprising inspecting the ends of the insert by analyzing images of the shear surfaces of the ends of the rod-like article.

7. The method of claim 6, wherein the inspection comprises measuring surface areas of shear surfaces of the insert at the ends of the rod like article.

8. The method of claim 6, wherein the inspection comprises analyzing measurement signals from microwave sensors.

9. The method of claim 1, wherein the weakenings in the insert material tape are formed by passing the insert material tape to an assembly prior to feeding the insert material tape into the strand of the filling material.

10. The method of claim 1, wherein the filling material contains tobacco.

11. The method of claim 1, wherein the weakening comprises two opposite cut-outs at longitudinal edges of the insert material.

12. The method of claim 1, further comprising incrementally adjusting the synchronization of the movement of the cutting head and the movement of the continuous rod, and inspecting the ends of the insert material for every adjustment.

13. An apparatus for manufacturing rod-like articles for tobacco industry, the rod-like articles comprising longitudinal inserts located in a filling material, wherein the apparatus comprises:

a. a wrapper feeding assembly configured to feed a continuous tape-like wrapper;

b. a filling material feeding assembly configured to feed a strand of the filling material;

c. an insert material tape feeding assembly configured to feed a tape of an insert material having weakenings into the strand of the filling material;

d. a garniture assembly configured to form a continuous rod comprising the filling material and the insert material;

e. a cutting head configured to traverse a weakening in the tape of the insert material forming rod-like articles with ends;

f. a conveyor configured to convey the rod-like articles to the continuous rod;

g. sensors configured to inspect the ends of the insert at the ends of a rod-like article;

h. a comparing unit configured to compare the ends of the insert with a predefined model to obtain a measure of similarity; and i. a controller configured to adjust, responsive to the measure of similarity, the cutting head with respect to a movement of the continuous rod such as to increase the similarity between the inserts at the ends of the rod-like articles to the model in a following rod like article.

14. The apparatus of claim 13, wherein the controller is configured to adjust the cutting head with respect to the movement of the continuous rod.

15. The apparatus of claim 14, wherein the adjusting of the cutting head comprises increasing an action of the cutting head.

16. The apparatus of claim 14, wherein the adjusting of the action of the cutting head comprises delaying the action of the cutting head.

17. The apparatus of claim 13, wherein the controller is configured to adjust the action of the cutting head with respect to the movement of the continuous rod by accelerating the movement of the continuous rod.

18. The apparatus of claim 13, wherein the controller is configured to adjust the action of the cutting head with respect to the movement of the continuous rod by decelerating the movement of the continuous rod.

* * * * *